US005144778A

United States Patent [19]

Pourtau et al.

[11] Patent Number: 5,144,778

[45] Date of Patent: Sep. 8, 1992

[54] PROFILED STRIP ADAPTED TO BE USED WHEN LAYING TILINGS OR OTHER SURFACE COVERINGS

[75] Inventors: Jean-Jacques Pourtau; Thierry Pourtau, both of Croissy sur Seine, France

[73] Assignee: Societe Anonyme, France

[21] Appl. No.: 672,692

[22] Filed: Mar. 18, 1991

[30] Foreign Application Priority Data

Mar. 30, 1990 [FR] France ..... 90 04115

[51] Int. Cl.[5] ..... E04B 1/00

[52] U.S. Cl. ..... 52/254; 52/287; 52/716

[58] Field of Search ..... 52/287, 288, 716, 312, 52/179, 783, 784, 254, 255

[56] References Cited

U.S. PATENT DOCUMENTS

| | | | |
|---|---|---|---|
| 1,836,911 | 12/1931 | Fitch | 52/784 |
| 2,952,496 | 9/1960 | Braal et al. | 52/783 |
| 3,242,627 | 3/1966 | Fountain | 52/288 X |
| 3,334,456 | 8/1967 | Naka | 52/179 |
| 3,387,419 | 6/1968 | Kamberg et al. | 52/255 |
| 4,052,830 | 10/1977 | Smith | 52/288 |
| 4,318,951 | 3/1982 | Naka et al. | 52/288 X |
| 4,321,294 | 3/1982 | Naka | 52/179 X |
| 4,748,780 | 6/1988 | Vinther | 52/783 X |
| 5,073,430 | 12/1991 | Aidan | 52/254 X |

FOREIGN PATENT DOCUMENTS

| | | | |
|---|---|---|---|
| 862360 | of 1953 | Fed. Rep. of Germany | 52/288 |
| 3840294 | 5/1990 | Fed. Rep. of Germany | 52/287 |
| 1338950 | 8/1963 | France | 52/254 |

*Primary Examiner*—David A. Scherbel
*Assistant Examiner*—Lan Mai
*Attorney, Agent, or Firm*—Marshall & Melhorn

[57] ABSTRACT

This invention relates to a profiled strip adapted to be used when laying tilings or other like surface coverings, wherein this profiled strip comprises: a bearing sole plate which is defined by a lower face, an upper face and an edge; a bead which, opposite the edge, is upstanding from the upper face of the bearing sole plate and its outer shape is that of a quadrant; and a counter-joint which is upstanding from the upper face of the bearing sole plate and constitutes the inner limit of the bead and of the bearing sole plate.

One application of the invention is the production of profiled trims having a good resistance in time.

12 Claims, 2 Drawing Sheets

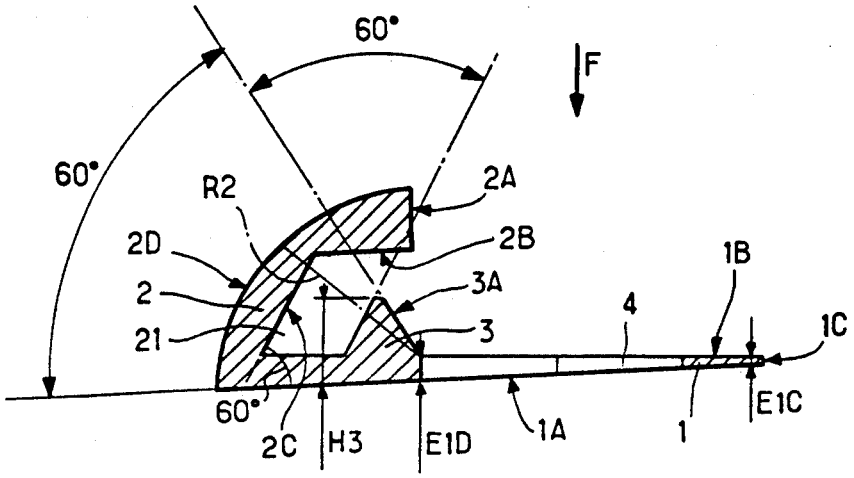
FIG. 1
FIG. 2
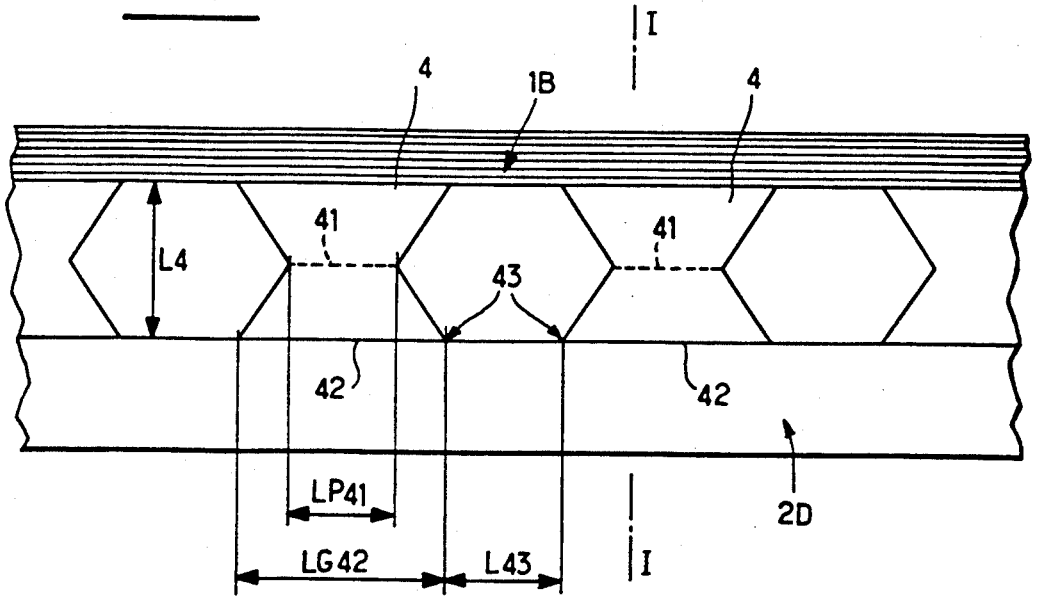

PROFILED STRIP ADAPTED TO BE USED WHEN LAYING TILINGS OR OTHER SURFACE COVERINGS

FIELD OF THE INVENTION

The present invention relates to a profiled strip adapted to be used when laying tilings or other coverings on generally horizontal or vertical surfaces.

BACKGROUND OF THE INVENTION

In this domain, a number of profiled strips responding to this need exists at the present time, for example metal or plastic profiled strips presenting a bearing flange with perforations of circular, trapezoidal or other varied shapes, said bearing flange presenting on one side a more or less inclined or rounded profile and a cross-section presenting two parallel or virtually parallel faces.

Such embodiments present drawbacks, principally concerning the correct seal of the joint, generally made with white cement, clogging the more or less wide void existing between the upper edge of the inclined or rounded flange and the last row of ceramic tiles for example.

Another drawback results from the lack of correct bond due to perforations more or less well adapted to a suitable anchoring in the adhesive mortar. Another drawback is also caused by certain heretofore known profiled strips of which the inclined or rounded flanges present too small cross-sections, this having for effect a poor resistance of these profiled strips in time after they have been laid.

It is precisely an object of the present invention to propose a profiled strip which enables the three drawbacks mentioned above to be eliminated.

SUMMARY OF THE INVENTION

The invention therefore relates to a profiled strip adapted to be used when laying tilings or other like surface coverings.

According to the invention, this profiled strip comprises: a bearing sole plate which is defined by a lower face, an upper face and an edge; a bead which, opposite the edge, is upstanding from the upper face of the bearing sole plate and its outer shape is that of a quadrant; and a counter-joint which is upstanding from the upper face of the bearing sole plate and constitutes the inner limit of the bead and of the bearing sole plate.

The following advantageous arrangements are, in addition, preferably adopted:

the bearing sole plate presents perforations each shaped as two equal trapezia whose small bases merge into one common small base, these various perforations being separated by solid parts;

the profiled strip presents the following dimensions: a) the common small base of the trapezia of a perforation has a length which is greater than half the length of a large base; b) the width of a perforation, equal to the sum of the heights of the two trapezia constituting it, is included between 0.5 and 1 times the length of the large base of a trapezium; c) the distance of the solid part separating the angles of two large bases of the trapezia of two successive perforations is included between 0.4 and 0.6 times the length of the large base of a trapezium;

said trapezia are isosceles trapezia;

the lower face of the bearing sole plate comprises parallel striae over the whole of its length and width;

the upper face of the solid parts of the bearing sole plate comprises parallel striae over the whole of its length and width;

the cross-section of the counter-joint is contained within the quarter circle defining the outer face of the quadrant constituting the bead;

the height of the counter-joint, measured from the lower face of the bearing sole plate, is at the most equal to 0.5 times the value of the radius of the outer face of the quadrant;

the face of the counter-joint, opposite the quadrant, is inclined by 60°, towards the quadrant, with respect to the lower face of the bearing sole plate;

the face of the counter-joint, opposite the quadrant, is entirely striated;

the quadrant comprises an inner recess defined by a plane upper face substantially parallel to the lower face of the bearing sole plate and by a plane inclined face, which, in cooperation with the outer face of said quadrant, defines the thickness of the matter constituting the quadrant, said plane inclined face being inclined with respect to the lower face of the bearing sole plate by an angle preferably equal to 60°;

the quadrant presents, at its end most remote from the bearing sole plate, a vertical face which continues the outer face of said quadrant, which extends substantially perpendicularly to the lower face of the bearing sole plate and which is entirely striated;

the thickness of the bearing sole plate near the edge is at the most equal to half the thickness located at the base of the quadrant.

The principal advantages of the invention reside in the good resistance, in time, of the finishing joint and in the perfect anchoring of the sole plate in the adhesive mortar.

BRIEF DESCRIPTION OF THE DRAWINGS

The invention will be more readily understood on reading the following description with reference to the accompanying drawings, in which:

FIG. 1 is a section along I—I of FIG. 2, of a profiled strip according to the invention.

FIG. 2 is a view in the direction of arrow F of FIG. 1.

DETAILED DESCRIPTION OF THE INVENTION

Figure 3:
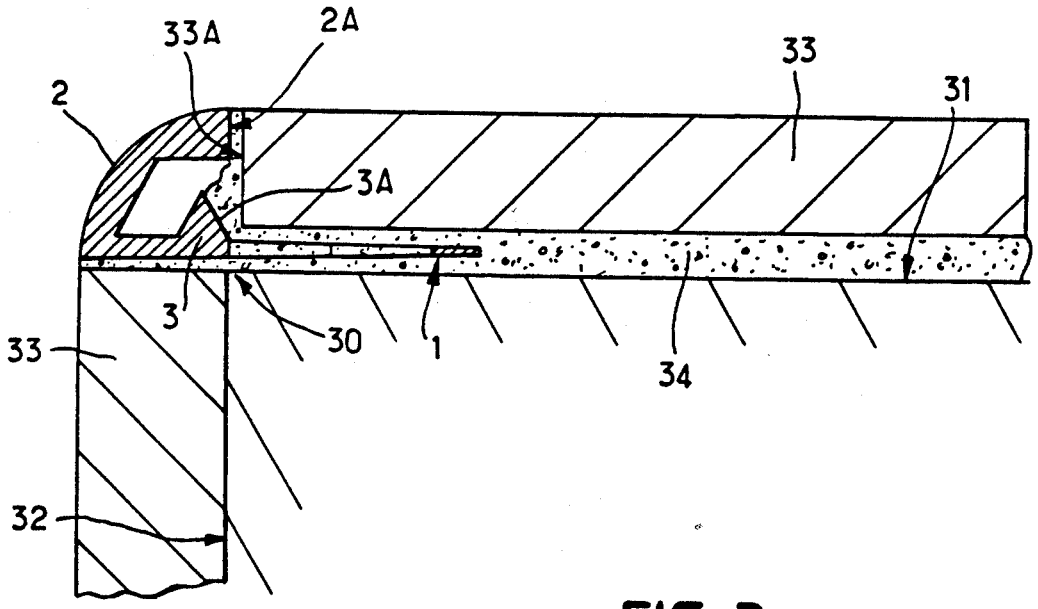
FIG. 3 is a section through the angle of two walls, the profiled edge of FIG. 1 having been laid.

Referring now to the drawings, FIG. 1 shows the profiled strip according to the invention, comprising a bearing sole plate 1 which presents, on one side, a rounded part 2 forming quadrant. A counter-joint 3 is located on and is upstanding from the upper face 1B of the bearing sole plate 1. This bearing sole plate 1 presents perforations 4.

The quadrant 2 of the profiled strip is recessed (21), the inner face of its cross-section being composed of a plane face 2B, parallel to the lower face 1A of the bearing sole plate 1, and a plane face 2C inclined at 60° with respect to the lower face 1A of the bearing sole plate 1, this face 2C defining, with the outer face 2D of the quadrant 2, the thickness of the matter constituting it. The vertical face 2A terminating the quadrant 2 is striated over the whole of its height. The radius R2 of this quadrant 2 is adapted to the different thicknesses usually encountered in tilings or other coverings available on the market, as shown in FIG. 3.

The counter-joint 3 is so located that it is inscribed in the quarter circle of radius R2 of the quadrant 2. The outer face 3A of the counter-joint 3 is inclined, with respect to the lower face 1A of the bearing sole plate, by 60° towards the inside of the quadrant 2 and is striated over the whole of its height.

The thickness E1C of the bearing sole plate 1 at the edge 1C opposite the quadrant 2 is less than or equal to half the thickness E1D of said bearing sole plate 1 at the base of the quadrant 2.

FIG. 2 shows the perforations 4 each shaped as two trapezia having their small base 41 common. The length LP41 of this small base 41 is greater than half the length LG42 of the large base 42, the solid part separating the two angles 43 of two successive large bases 42 of two perforations 4 being equal to half the length LG42 of a large base 42. The sum L4 of the heights of the two trapezia constituting each perforation is included between half and the whole of the length LG42 of the large base 42 of a trapezium.

FIG. 2 also shows the upper face 1B of that part of the bearing sole plate 1 having no perforations, which is striated over the whole of its width and length.

The lower face 1A of the bearing sole plate 1 is also striated over the whole of its width and length.

The following should be noted:

the distance L43 of the solid part separating two perforations, measured between the angles 43 of two large bases 42 of the trapezia of the two successive perforations 4, is included between 0.4 and 0.6 times the length LG42 of a large base 42, and preferably equal to 0.5 times the length LG42;

the various trapezia are isosceles trapezia, and equal;

the cross-section of the counter-joint 3 is contained within the quarter circle defining the outer face 2D of the quadrant 2;

the height H3 of the counter-joint 3, measured from the lower face 1A of the bearing sole plate 1, is at the most equal to 0.5 times the radius R2 of the outer face 2D of the quadrant 2.

FIG. 3 shows the angle 30 of two walls 31 and 32, equal to 90°. The two walls are covered with ceramic tiles 33 and a profiled strip according to the invention constitutes the finishing trim of the angle made by the two walls. It is fixed by sealing in the adhesive mortar 34 used for laying the tiles of one of the walls. The angles 43 of the trapezia constituting the perforations 4 ensure impeccable fixing of the profiled strip in all directions. The counter-joint 3 avoids the fall of the adhesive mortar located between the face 2A of the quadrant 2 and the edge 33A of the adjacent tile.

As shown in FIG. 2, the perforations or apertures 4 in the sole plate 1 are spaced between hexagonal sections of the sole plate 1. The center width LP41 is greater than half the outer width LG42 of the perforations 4. Mortar can be formed and hardened in the perforations 4, which prevents the profiled strip from sliding or moving after installation. The angled sides of the perforation 4 have been found to improve the anchoring of the mortar.

The upper surface of the sole plate 1 has striations 1B extending the full length of the sole plate 1. The lower surface 1A, the side surface 2A, and the angled surface 3A of counter-joint 3 are also striated. The striations in the various surfaces of the present invention provide for improved bonding between the mortar 34 and the surfaces of the profiled strip with edge cover 2. The striations also help reduce cracking and shifting of the mortar 34 after the mortar has hardened.

The counter-joint 3 and striated surfaces 2A and 3A improve the bonding and minimize the cracking and chipping of the adhesive mortar 34 located between the face 2A of the edge cover 2 and the edge 33A of the adjacent tile 33. Because cracking and chipping of the mortar 34 is minimized, the tiles 33 do not loosen and the overall integrity of the surface can be maintained for a longer period of time. The length of the face 3A of the counter-joint 3 is equal to or less than half of the radius R2. This provides a sufficient surface 2A for bonding with the tile 33 and provides a reinforced mortar 34 segment to maintain the desired surface. At the time of installation, the volume of mortar 34 contained between the surfaces 3A and 33A is important. The counter-joint design of the present invention increases the volume of mortar 34 and the striated surfaces of the side face 2A and angled surface 3A improve the bonding of the mortar 34.

The invention is not limited to the embodiment described, but covers, on the contrary, all variants which may be made thereto without departing from its scope nor its spirit.

What is claimed is:

1. A profiled edge strip to be bonded by mortar to a row of tile or other like surface coverings comprising:
   - an elongated sole plate including a lower surface, an upper surface and a longitudinal edge;
   - a quadrantal edge cover integrally formed in and extending along an edge of said sole plate opposite the longitudinal edge, said edge cover including a partial side face in a plane perpendicular to the lower surface of said sole plate, and an arcuate outer surface; and
   - a counter-joint formed between the upper surface of said sole plate and the partial side face of said edge cover, said counter-joint including an inclined surface extending from the upper surface of said sole plate towards the arcuate outer surface of said edge cover, whereby additional mortar is retained in said counter-joint to improve the bond between the profiled strip and the row of tile; and said edge cover includes a longitudinal aperture extending the full length of said edge cover and an opening into said longitudinal aperture, said opening being positioned between the side face of said edge cover and the counter-joint.

2. The profiled strip of claim 1 wherein the inclined surface of said counter-joint is inclined towards the outer surface of said edge cover at an angle of about 60 degrees from the lower surface.

3. The profiled strip of claim 1 wherein the inclined surface of said counter-joint is striated.

4. The profiled strip of claim 1 wherein the length of the inclined surface of said counter-joint is less than 50% of the length of the radius for the arc of the outer surface on said edge cover.

5. The profiled strip of claim 1 wherein the lower surface of said sole plate and said edge cover includes a striated surface.

6. The profiled strip of claim 1 wherein the upper surface of said sole plate includes a striated segment adjacent to the longitudinal edge of said sole plate.

7. The profiled strip of claim 1 wherein the lower surface of said sole plate is thinner at the longitudinal edge than at the opposite edge adjacent to the edge cover.

8. The profiled strip of claim 1 wherein the side face of said edge cover includes a striated surface.

9. The profiled strip of claim 1 wherein said sole plate includes spaced-apart apertures between the upper surface and the lower surface.

10. The profiled strip of claim 9 wherein said sole plate includes hexagonal segments of sole plate between said apertures.

11. The profiled strip of claim 1 wherein the longitudinal aperture is in the shape of a parallelogram in transverse section.

12. A profiled strip for edging a row of tile or other like surface over affixed to a base by mortar or the like comprising:

an elongated sole plate including a striated lower surface, a longitudinal edge, and an upper surface having a striated segment adjacent to the longitudinal edge;

a plurality of spaced-apart apertures between the upper surface and the lower surface of said sole plate, said sole plate being hexagonal in shape between said apertures;

a quadrantal edge cover integrally formed on and extending along an edge of said sole plate opposite the longitudinal edge, said edge cover including a longitudinal aperture extending the full length of said edge cover, a striated, partial side face in a plane perpendicular to the lower surface of said sole plate, and an arcuate outer surface extending from the lower surface to the partial side face in a 90 degree arc; and a counter-joint formed between the upper surface of said sole plate and the partial side face of said edge cover, said counter-joint including an inclined surface extending from the upper surface of said sole plate towards the arcuate outer surface of said edge cover, whereby additional mortar is retained in said counter-joint to enhance the bond between the profiled strip and the row of tile; and said edge cover further includes an opening into the longitudinal aperture, said opening being positioned between the side face of said edge cover and said counter-joint.

* * * * *